United States Patent [19]

Batori

[11] 4,027,883

[45] June 7, 1977

[54] METHOD FOR AIMING A BILLIARDS BANK SHOT

[76] Inventor: Michael C. Batori, 01710 SW. Riverdale Road, Portland, Oreg. 97219

[22] Filed: Sept. 22, 1975

[21] Appl. No.: 615,244

[52] U.S. Cl. ..... 273/14

[51] Int. Cl.[2] ..... A63D 15/00

[58] Field of Search ..... 273/14, 8, 9; 356/172, 356/142, 147; 350/288, 161, 298, 193; 33/46

[56] References Cited

UNITED STATES PATENTS 3,463,593 8/1969 Horan ..... 273/14

*Primary Examiner*—Richard C. Pinkham
*Assistant Examiner*—T. Brown
*Attorney, Agent, or Firm*—Chernoff & Vilhauer

[57] ABSTRACT

An apparatus and method for rapidly and accurately aiming a billiard bank shot. A movable base supports a plane reflective surface above the playing field of a billiard table such that the reflective surface is generally perpendicular to the playing field and parallel to the face of a cushion at a predetermined distance inward therefrom. The bank shot is aimed by positioning the reflective surface longitudinally along the cushion opposite the target and relative to a billiard ball such that the billiard ball may be aligned directly with a reflected image of the target. Adjustable means are provided for varying the predetermined inward distance of the reflective surface from the face of the cushion, and for adapting the apparatus to billiard tables having various width cushions. Guide means are provided for automatically positioning the reflective surface at the predetermined distance inward from the cushion and parallel thereto.

10 Claims, 6 Drawing Figures

METHOD FOR AIMING A BILLIARDS BANK SHOT

BACKGROUND OF THE INVENTION

This invention relates to an apparatus and method for aiming a bank shot in a game of billiards, and particularly to a training apparatus and method for teaching the art of making accurate bank shots.

In playing the various games of billiards, including pocket billiards, it is frequently desirable or necessary to execute a shot whereby an object ball or the cue ball is bounced against a cushion along one of the four sides of the billiard table en route to its target, commonly known as a "bank shot." In contrast to other shots which may be aimed by aligning the ball directly with its target, the bank shot is relatively difficult to aim since the ball cannot be so aligned; rather, an intermediate target point on the face of the cushion must be determined which will cause the object ball to rebound toward its target on a proper course, and the ball must be aimed at that point. In addition the bank shot is complicated by the fact that the size of the billiard ball, the relative resiliency of the cushion and the force of the shot, i.e. the energy imparted to the ball, all affect the location of the proper intermediate target point on the cushion.

While one can learn to make successful bank shots by utilizing mechanical devices to estimate geometrically the intermediate target point on the cushion, by trial and error or by other similarly complicated or inefficient methods, such approaches are less than completely satisfactory because they consume an inordinate amount of time and their success is limited by the indirectness with which the intermediate target point is determined. It is well known that the process of learning a skill is made more effective by positive reinforcement, that is by attempts culminating in success, and it follows that one could more rapidly learn to make accurate bank shots if the success rate could be increased and the time period required for each attempt could be decreased. Therefore, it can be seen that there is a need for an easy-to-use apparatus and method for aiming bank shots accurately in less time than has heretofore been possible, and with an improved success rate.

SUMMARY OF THE INVENTION

The present invention satisfies the aforementioned need by providing a light-reflecting surface positioned above the playing field of a billiard table and positioned adjacent a cushion. Preferably the reflective surface has a plane configuration and is positioned perpendicular to the playing field and parallel to the face of the cushion at a predetermined distance inward therefrom. With proper positioning, light will be reflected from the plane reflective surface at the same angle that a ball bounces off of the cushion. Accordingly the reflective surface can be positioned along the cushion at a location to reflect an image of the target, that is, a pocket or another ball, along a line of sight which may be aligned directly with the ball as in a direct shot, and the ball if aimed directly at the reflected target image will follow a path identical to the light and therefore to the target.

A base is provided for holding the reflective surface, typically an ordinary mirror, in the proper position relative to the cushion, target and ball. The base should be capable of suspending the reflective surface a spaced distance above the playing field, such spaced distance being greater than the diameter of a billiard ball, at a position parallel to the face of the appropriate cushion and a predetermined distance inwardly therefrom in order for the path of the ball to follow the path of the light. At the same time the base should be provided with means for easily moving the reflective surface longitudinally along the cushion such that the surface may be positioned at any intermediate target point along the perimeter of a billiard table regardless of the presence of pockets.

In the preferred embodiment, proper positioning of the reflective surface is obtained by means on the base for supporting the reflective surface in a laterally extended position and by a guide which rests against the face of the cushion for automatically positioning the surface relative to the cushion, and by such guide being removable for execution of the bank shot. Mobility is accomplished by three wheels attached to the base at particular locations which enable it to roll along the top of a rail of the billiard table and assume a position very close to a pocket if necessary.

Also, adjustable means are provided for varying the predetermined inward distance from the face of the cushion to the plane of the reflective surface in order to account for the finite radius of the object ball, the resilient character of the particular cushion and the intensity of the shot to be expected for the particular player, since the position of the intermediate target point will vary with each of these parameters. In the preferred embodiment this variation may be achieved either by adjusting the position of the mirror inward or outward relative to the base, or by adjusting the position of the guide relative to the base.

In the preferred embodiment the base and guide may be conveniently manipulated from the opposite side of the billiard table where a player can see the image and execute the shot. This is accomplished by pushing the apparatus longitudinally along the rail of the billiard table to the proper position and raising and lowering the guide, both with the tip of the cue stick.

It is therefore a principal objective of the present invention to provide a new and useful apparatus and methodfor rapidly and accurately aiming a billiard bank shot.

It is another principal objective of the present invention to enable an accurate bank shot to be aimed by aligning a billiard ball directly with a reflected image of its target.

It is a principal feature of the present invention that it utilizes a surface for reflecting light which is appropriately positioned relative to a target, a cushion and a billiard ball such that the bank shot may be aimed by aligning the billiard ball directly with the reflected image of the target and stroked while the reflective surface remains in place.

It is another principal feature of the present invention that it includes means for automatically positioning a plane reflective surface such that it is parallel to the face of the side cushion and a predetermined distance inward therefrom.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
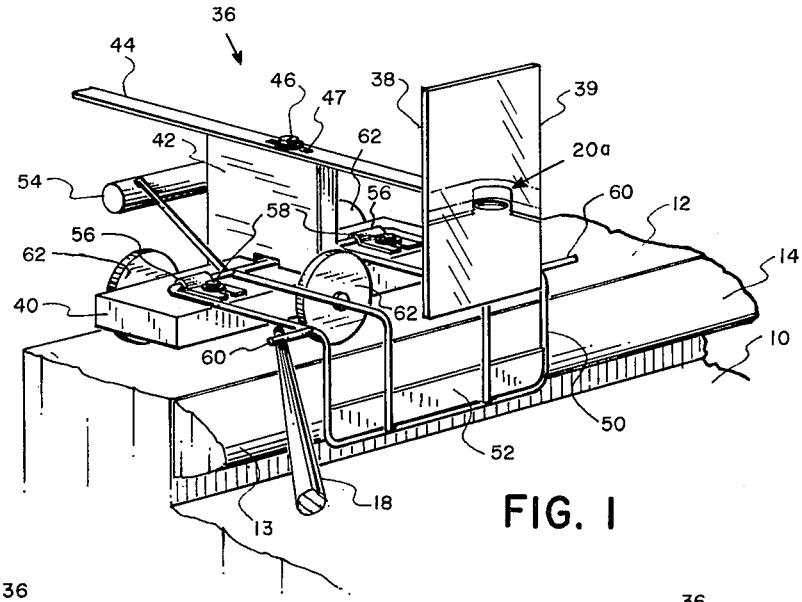
FIG. 1 is a perspective view of a preferred embodiment of an apparatus constructed according to the principles of the present invention mounted on a side rail of a billiard table, showing a reflected target image.
Figure 2:
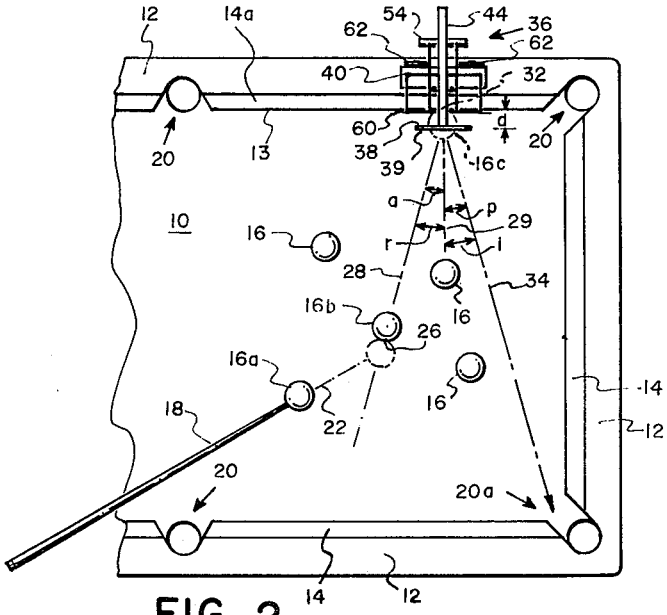
FIG. 2 is a top view of the preferred embodiment of the present invention, showing a portion of a pocket billiard table upon which the apparatus is mounted and several billiard balls positioned to represent a typical bank shot situation.

A typical billiard table, as partially illustrated in FIGS. 1 and 2, comprises a flat, horizontal surface known as the playing field 10, a plurality of rigid peripheral rails 12 which rise above the playing field, and a plurality of elongate resilient cushions 14 attached on the inside of the rails 12 each having a face 13 directed inwardly and elevated slightly above the playing field. The various games of billiards are played with a plurality of billard balls 16, commonly including a single cue ball 16*a* which may be propelled against an object ball 16*b*, the object ball being chosen from among the other billiard balls. The billiard shot is executed by striking the cue ball 16*a* with the end of a cue stick 18. A number of billiards games are played on a specific type of table, known as a pocket billiard table, having a plurality of pockets 20 for receiving the billiard balls. In addition, the size of the billiard balls 16 may vary depending upon the type of table and the type of game being played.

The particular type of shot with which the present invention is concerned is known as a bank shot and is executed by bouncing one of the billiard balls 16 off of a face 13 of a resilient cushion 14 in order to strike its target, which may be a pocket or another billiard ball. In an exemplary bank shot as shown in FIG. 2, the objective is to strike the object ball 16*b* with the cue ball 16*a* and thereby knock the object ball into a target pocket 20*a*. In order to accomplish this shot the cue ball 16*a* is struck by the cue stick 18 such that it follows a path 22 until the cue ball strikes the object ball at a point 26, thereby propelling the object ball along the initial path 28. Thereafter the object ball strikes a point at position 32 on the face of the cushion 14*a*, as shown in phantom, which causes the object ball 16*b* to be propelled back along path 34 to the target pocket 20*a*. The angle of approach *a* of the ball 16*b* to the cushion, measured between the path 28 and a line 29 perpendicular to the face of the cushion, equals the angle of departure *p* measured between path 34 and line 29. While a number of other bank shots might also be made, for example where the cue ball strikes a cushion prior to striking the object ball (the object ball thereby becoming the target) and the object ball thereafter proceeds directly to the pocket, the particular shot shown illustrates the principles of the present invention.

The essential feature of the present invention which enables the objectives to be achieved, as illustrated by the preferred embodiment 36, is the placement of a reflective surface 38 at such a position along the cushion 14*a* that the billiard ball which is to be bounced off of the cushion may be aimed directly at the reflected image of its target as though a direct shot were to be executed rather than a bank shot. In the example shown an ordinary mirror is utilized wherein the reflective surface 38 is actually a silvered layer applied to the backside of a sheet of glass 39 such that the light travels into and through the glass, is reflected at its backside and thereafter travels back through the glass and out. However, it is recognized that other reflecting devices such as highly polished metal wherein the reflective surface is on the front might also be utilized without departing from the principles of this invention. Preferably the reflective surface 38 is plane, in which case it is positioned parallel to the face 13 of the cushion 14*a* at a predetermined distance *d* inwardly therefrom. The parallel relationship between the plane reflective surface and the face of the cushion is necessary in order for the path of the ball to be identical to the path of the light image at which the shot is aimed; that is, the angle of incidence *i* and the angle of reflection *r* respectively at which the target image travels to and from the reflective surface must be equal to the angles *p* and *a* respectively which define the path of the billiard ball. The positioning of the plane reflective surface a predetermined distance *d* inwardly from the face of the cushion is necessary to allow for the finite thickness of billiard balls, since a billiard ball is aimed through its center yet actually strikes objects at its periphery, and to allow also for the deflection of the resilient cushion upon being struck by the ball. The magnitude of the predetermined distance *d* will be discussed hereafter in greater detail.

While not absolutely necessary, it is highly desirable for convenience and accuracy to utilize a reflective surface tall enough that the target image and ball may be aligned regardless of their positions on the playing field without changing the vertical positioning of the reflective surface. Also, the bottom of the reflective surface should be positioned a distance above the playing field 10 greater than the diameter of the billiard balls so that a ball may roll beneath the surface to the cushion, enabling the shot to be made while the reflective surface remains in proper position.

The preferred embodiment of the aiming apparatus 36 has a base member 40 for riding on the rail 12 of a billiard table, and a vertical support member 42 attached to the base. The reflective surface 38 is mounted by means of a horizontally disposed arm 44 which is adjustably attached to the vertical support member 42 by a threaded fastener 46 placed through an elongate slot 47. The adjustability of the arm 44 enables the position of the reflective surface 38 to be changed with respect to the base 40 to accomodate various cushion thicknesses and to permit adjustment of the distance *d* for varying billiard ball diameters, varying cushion resiliency, and varying intensities with which different players strike the billiard ball, so that the center of a given billiard ball will bounce from the cushion (i.e. change directions) at about the point where the center lies in the plane of the reflective surface 38. Thus the distance *d* should be equal to or less than the radius of the billiard ball, and should be reduced by adjustment as the intensity with which the ball is struck, and/or the resilience of the cushion, increases because of the resultant increased deflection of the cushion.

Figure 3B:
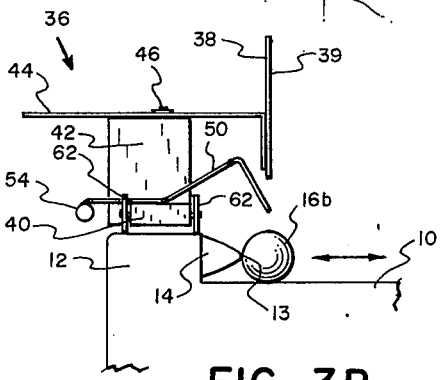
FIG. 3B is a side view of the present invention showing the aforementioned guide mechanism raised for executing the bank shot.
Figure 3A:
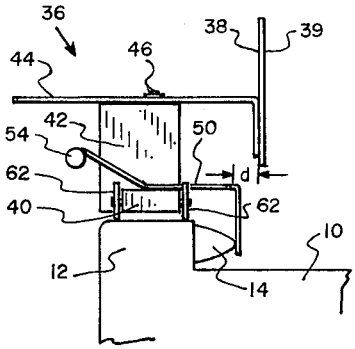
FIG. 3A is a side view of the present invention mounted upon a billiard table showing a guide mechanism employed for positioning the reflective surface.

Means are provided for automatically maintaining the predetermined distance *d*, once established by proper adjustment, and for maintaining parallelism between the cushion and the reflective surface. In the preferred embodiment a guide 50 having a downwardly bent portion with an elongate rub plate 52 attached thereto is pivotally attached to the base 40 such that it may be placed, alternatively, either in a down position as shown in FIG. 3A with the rub plate parallel to the reflective surface 38 so as to rest against the face 13 of the cushion and thereby properly position the reflective surface, or in an up position as shown in FIG. 3B for permitting a billiard ball to strike the cushion adjacent the aiming apparatus without interference from the guide. A counterweight 54 may be provided for balancing the guide in either the up or down positions. The guide is attached to the base member 40 by a pair of slotted tabs 56 and threaded fasteners 58 such that the position of the base relative to the face of the cushion may be varied for further adjustment of the position of the reflective surface, or for accomodating various thicknesses of side cushions. A pair of outwardly projecting fingers 60 are attached to the guide 50 for conveniently moving the guide from its down position to its up position and vice versa by the touch of a cue.

Three wheels 62 are attached to the base member 40 for movingly supporting the base on the rails of the billiards table. Two of the wheels are mounted on the side of the base opposite to that from which the reflective surface projects, and the third is mounted on the same side as the reflective surface so that the aiming apparatus may be moved with a portion of the base over a pocket, so that the reflective surface may be positioned very close to the pocket if necessary. The provision of wheels for moving the aiming apparatus back and forth laterally, together with the finger members 60 on the guide 50, enable the aiming apparatus to be manipulated entirely by the tip of a cue stick from the opposite side of the table, that is, from the side from which the player would ordinarily execute the bank shot.

Figure 4A:
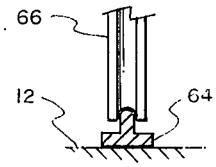
FIG. 4A is a detail view of a wheel and guide track portion of the aforementioned alternative embodiment of the present invention shown in FIG. 4.
Figure 4:
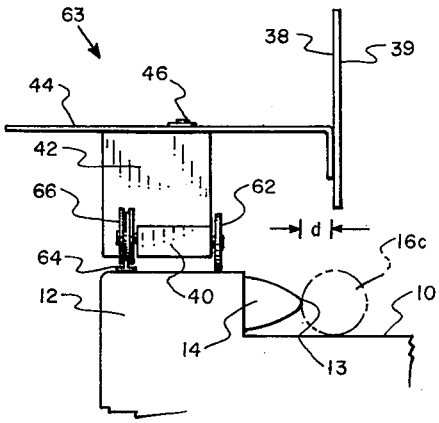
FIG. 4 is a side view of an alternative embodiment constructed according to the principles of the present invention utilizing a different type of guide.

It is recognized that while the preferred embodiment of the aiming apparatus is particularly suitable for performing the foregoing functions, other structures might also be designed and utilized without departing from the basic principles of properly positioning a reflective surface relative to the cushion, billiard ball and target such that the billiard ball can be aligned directly with the reflected image of the target. For example, the guide 50 might be replaced by a track 64 parallel with the cushion face and a pair of grooved wheels 66 which ride thereon, as shown by an alternative embodiment 63 in FIGS. 4 and 4A. The track has an upside-down T-shaped cross-section with the horizontal portion of the T adhered to the top surface of the table rail and the wheel 66 riding on the upwardly projecting portion of the track.

Another alternative arrangement (not shown) might feature a depending guide adapted to ride the outside vertical surface of the rail, assuming that the table is constructed such that such surface is parallel to the cushion face.

Any of the embodiments of the aiming apparatus disclosed herein is utilized by placing it on the rail of the pool table adjacent a cushion against which a bank shot is to be made, and thereafter positioning the apparatus along the cushion such that a reflected image of the target, that is a pocket or another billiard ball, may be aligned directly with the billiard ball which is to be bounced off of the cushion. If the reflective surface is plane, it is positioned parallel with the cushion and located the predetermined distance *d*, no greater than the radius of the billiard ball, inwardly from the face of the cushion by means of the guide 50 or other similar guide means. In the example shown the object ball **16*b* is to be bounced off of the side cushion 14*a*. Accordingly the aiming device 36 is moved until both the reflected image of the target pocket and the ball 16*b* can be viewed along a single line 28. A mental note is made of the point 26 where the ball 16*b* must be struck to impel the ball along line 28. The guide 50 is raised and the cue ball 16*a* is aimed so as to strike the ball 16*b* at the point 26. This impels the ball 16*b* toward the reflected target image and, after rebounding from the cushion, into the target pocket 20*a*.**

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of aiming a billiards bank shot, whereby a billiard ball on the playing field of a billiard table is bounced off of the face of a cushion of said table toward a target, which comprises positioning a reflective surface at a location adjacent a cushion of said table relative to said billiard ball and target such that said billiard ball is visually alignable along a straight line with an image of said target reflected from said reflective surface, and visually aligning said billiard ball with said reflected image along said straight line.

2. The method of claim 1, further comprising positioning said reflective surface by manipulating it with a cue stick.

3. A method of aiming a billiards bank shot, whereby a billiard ball on the playing field of a billiard table is bounced off of the face of a cushion of said table toward a target, which comprises positioning a plane reflective surface adjacent a cushion of said table parallel to the face of said cushion and spaced a predetermined distance inward therefrom at a location relative to said billiard ball and target such that said billiard ball is visually alignable with an image of said target reflected from said reflective surface, and visually aligning said billiard ball with said reflected image.

4. The method of claim 3 wherein said predetermined spaced distance is no greater than the radius of said billiard ball.

5. The method of claim 4 wherein said predetermined distance is less than the radius of said billiard ball so as to compensate for deflection of said cushion.

6. A method of aiming a billiards bank shot, whereby a billiard ball on the playing field of a billiard table is bounced off of the face of a cushion of said table toward a target, which comprises positioning a reflective surface at a location adjacent a cushion of said table relative to said billiard ball and target such that said billiard ball is visually alignable with an image of said target reflected from said reflective surface and such that the bottom of said reflective surface is elevated above the face of said cushion so as to permit said bank shot to be made while said reflective surface is so positioned, and visually aligning said billiard ball with said reflected image.

7. The method of claim 6, further comprising positioning said reflective surface in said position at a predetermined distance inward from the face of said cushion and such that the bottom thereof is spaced above the playing field of said table by a distance greater than the diameter of said billiard ball.

8. A method of aiming a billiards bank shot, whereby a billiard ball on the playing field of a billiard table is bounced off the face of a cushion of said table toward a target, which comprises movably mounting a reflective surface on the rail of said billiard table adjacent said cushion and positioning said reflective surface, by moving said reflective surface longitudinally along the length of said cushion, at a location relative to said billiard ball and target such that said billiard ball is visually alignable with an image of said target reflected from said reflective surface, and visually aligning said billiard ball with said reflected image.

9. The method of claim 8 wherein said reflective surface is plane, further comprising maintaining said reflective surface substantially parallel to the face of said cushion and at a predetermined distance inward therefrom while moving said reflective surface longitudinally along the length of said cushion.

10. The method of claim 9, further comprising the step of positioning said reflective surface at said predetermined distance inward from the face of said cushion by adjustably moving said reflective surface in a direction perpendicular to said face of said cushion.

* * * * *

UNITED STATES PATENT AND TRADEMARK OFFICE

CERTIFICATE OF CORRECTION

PATENT NO. : 4,027,883

DATED : June 7, 1977

INVENTOR(S) : Michael C. Batori

It is certified that error appears in the above-identified patent and that said Letters Patent are hereby corrected as shown below:

Col. 2, line 46 Change "methodfor" to --method for--.

Col. 7, line 16 After "off" add the word --of--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*